US006044565A

United States Patent [19]

Arend et al.

[11] Patent Number: 6,044,565

[45] Date of Patent: Apr. 4, 2000

[54] PHYSIOLOGICALLY APPROPRIATE HAND-HELD CUTTER FOR FABRIC AND SHEET GOODS

[75] Inventors: Robert G. Arend; Todd J. Arend, both of Columbus, Ohio; Suzanne K. Shearer, Tacoma, Wash.

[73] Assignee: AC Marketech International Ltd., Columbus, Ohio

[21] Appl. No.: 09/081,453

[22] Filed: May 19, 1998

[51] Int. Cl.[7] ..... B26B 3/00; B26B 29/02

[52] U.S. Cl. ..... 30/319; 30/292; D7/694

[58] Field of Search ..... 30/292, 307, 319; D7/694

[56] References Cited

U.S. PATENT DOCUMENTS

| | | | |
|---|---|---|---|
| D. 222,380 | 10/1971 | Fraioli, Sr. | D7/694 |
| 1,663,748 | 3/1928 | Bender et al. | 30/292 |
| 4,432,137 | 2/1984 | Okada | 30/292 |
| 5,101,564 | 4/1992 | Melter | 30/319 |
| 5,711,077 | 1/1998 | Schulz et al. | 30/319 |
| 5,765,289 | 6/1998 | Schulz et al. | 30/319 |

*Primary Examiner*—Hwei-Siu Payer
*Attorney, Agent, or Firm*—Porter, Wright, Morris & Arthur LLP

[57] ABSTRACT

A physiologically appropriate hand-held cutter for fabric and sheet goods comprising a rotary cutter blade encased within a handle that includes a recessed depression within the handle surface essentially proximate the area of the handle enclosing the blade within which the user's thumb is positioned when the cutter is in use and optionally including a head section forward the section enclosing the blade for receiving the user's forefinger. The cutter fits naturally in the palm of the hand and reduces strain on the carpel tunnel area of the wrist.

9 Claims, 3 Drawing Sheets

8
24
25
23
20A
22
21

32
34
7
6
20B
36
31

PHYSIOLOGICALLY APPROPRIATE HAND-HELD CUTTER FOR FABRIC AND SHEET GOODS

FIELD OF THE INVENTION

This invention relates to a hand-held cutter for fabric and sheet goods. The cutter is physiologically and ergonomically appropriate to hand and arm movement in fabric and sheet goods cutting operations.

BACKGROUND AND PURPOSE OF THE INVENTION

Professions, hobbies and crafts that involve the utilitarian and creative forming of fabric and sheet goods such as thin leathers and comparable materials are well known. Quilting, dressmaking, sewing and other crafts are hobby and workplace activities that require a sheet material to be cut to a predetermined size before it is fabricated into a finished good. On many occasions, the cutting of multiple pieces is required. In quilting applications, for example, multiple duplicates of woven fabric pieces are assembled into designs that are repeated in the overall pattern of a quilt. This requires repetitive cutting. Star patterns having separate points radiating from a central five-sided shape are an example.

In the prior art, hand-held cutters used with a quilting ruler such as that described in U.S. Design Pat. No. 311,873 "Quilting Ruler" (issued Nov. 6, 1990) facilitate the task of repetitive cutting. These cutters provide an advantage of speed and accuracy when compared to the process of cutting that uses hand scissors.

The hand-held cutters used in the prior art with a quilting ruler can be characterized as simple devices that include a cutting wheel mounted at the end of a stick handle. The use of such a device involves substantial wrist movement. With current concerns expressed about repetitive stress injuries, carpal tunnel syndrome and other muscular-skeletal afflictions, there exists a need to provide a hand-held cutter that is less stressful in the physiological environment of fabric and sheet material cutting.

Thus, it is an object of the present invention to provide an improved hand-held cutter for fabric and sheet goods that is physiologically and ergonomically appropriate. It is a further object to provide a physiologically conforming grip in a hand cutter which reduces wrist stress and wrist movement. It is also an additional object of the invention to transfer the physiological stress caused by the use of a hand cutter from the wrist to larger muscular skeletal groups in the arm and shoulder and to reduce wrist stress in cutting motions.

These and other objects and features of the invention are explained below with reference to the description of the preferred embodiment taken in conjunction with the drawings in which:

DESCRIPTION OF THE DRAWINGS

FIG. 1 shows a perspective view from the top of the cutter, showing its components and contours.

FIG. 3 also illustrates the physiologically conformed contours molded in the tool handle.

DESCRIPTION OF THE PREFERRED EMBODIMENT

Figure 1A:
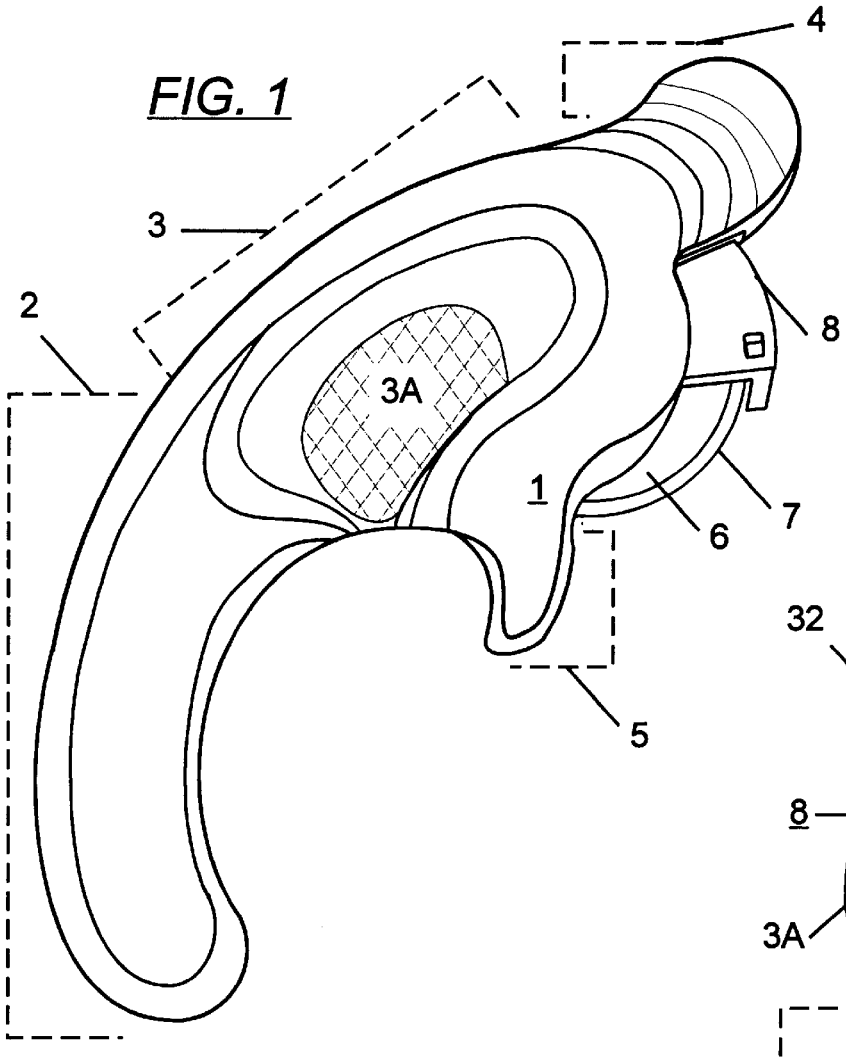
FIG. 1A is a front plan view of the cutter.
Figure 1A:
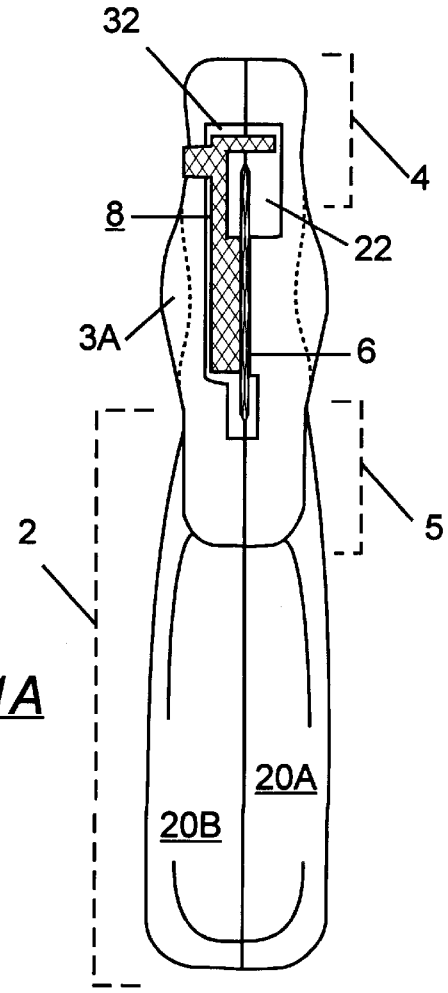

The invention is a hand cutting tool with a rotary wheel cutter useful in fabric and sheet material cutting. With reference to FIG. 1, the tool 1, includes a contoured gripping handle section 2 that extends to a wheel mounting section 3 and front section 4. Between the gripping section 2 and the front section 4, the surface of the handle includes an inward contour depression 3A for receipt of the user's thumb or index finger (on the different sides) therein. In a transverse cross-section, forward section 4 tapers downward from the uppermost part of the wheel section 3. Within the handle are contained the rotary cutting blade wheel 6 having cutting edge 7 and a retractable guard 8 that shields the cutting edge of the cutting blade. The handle is formed from two components having exterior surfaces that are essentially mirror images of one another; however, the sections are differently adapted on the interior to adapt to the wheel and guard assembly. FIG. 1A shows the assembly of the two handle components 20A and 20B and depicts the interior configuration adapted to the blade 6 and guard 8 mounted therein.

Figure 2A:
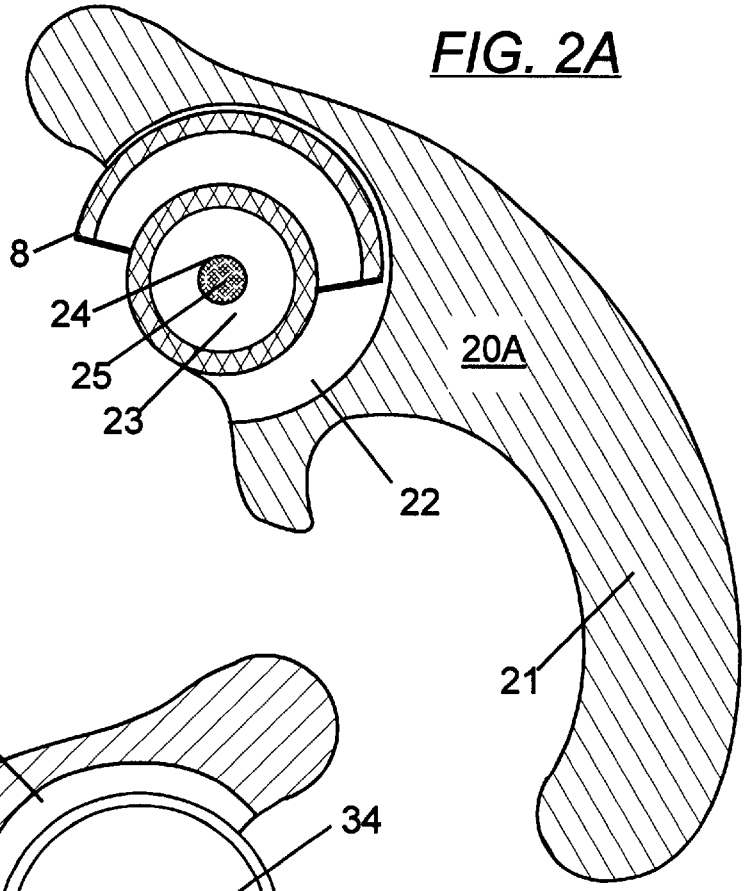
FIGS. 2A and 2B are inside views showing the first and second mating sections of the component assembly and the blade, axle and blade guard assembly relationship within the handle.
Figure 2B:
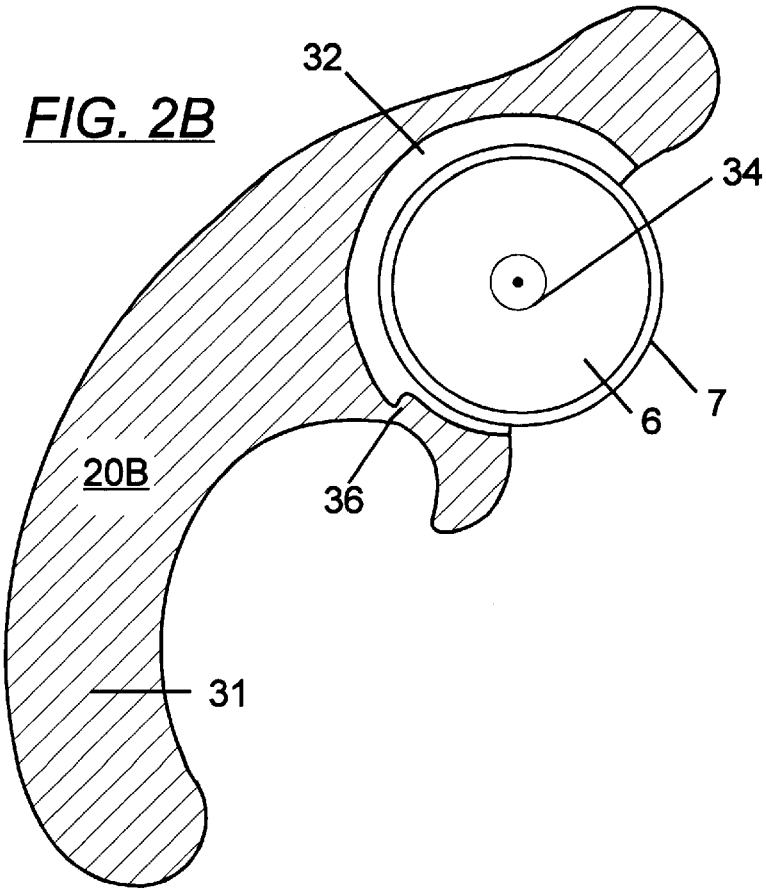

FIGS. 2A and 2B show the interior assembly of the cutter. In its preferred form, the cutter handle is formed from mating sections 20A and 20B that are essentially mirror images of the other externally, but which internally are differently adapted to receive the different parts of the cutter assembly. Components 20A and 20B have flat interior surfaces that mate to form the handle when joined. Referring to FIG. 2A, the interior flat surface 21 of the handle section 20A includes a circular recess 22 that concentrically surrounds the blade guard and a hub 23 within which is centered a recessed hole 24 for receiving an axle 25 on which the cutting blade is mounted. On the hub 23, the retractable blade guard 8 is mounted in a rotatable relationship therewith that allows limited rotation of the guard, in closed position to entirely cover the blade, and in retracted position to expose the blade to permit its cutting function.

The companion element 20B shown in FIG. 2B likewise includes a flat interior side 31 adapted to mate with companion flat side 21 in the section 20A. Side 21 of the handle component also includes a circular recessed section 32 corresponding to recess 22 in mating piece 21. Concentric within recess 32 is a recessed hole 34 which receives the extending section of axle 25 when the sections 20A and 20B are mated in a complete assembly of the tool. The recess 32 also includes a stop section 36 formed therein, to restrict movement of the blade guard.

Figure 3:
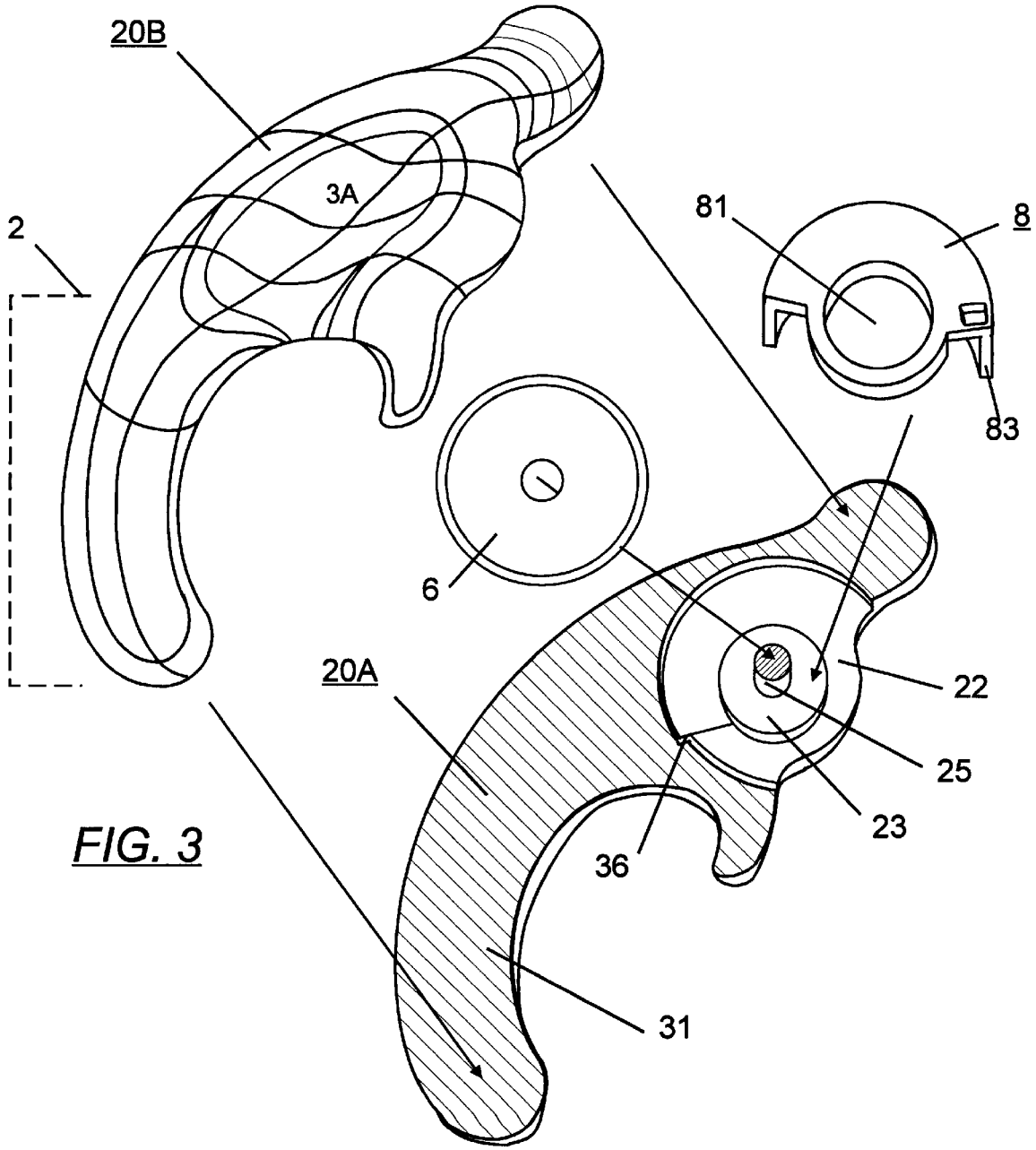
FIG. 3 is a drawing showing the assembly relationship of the components.

FIG. 3 shows the assembly relationship of the tool components and further details of the tool elements. As discussed above, 20A and 20B comprise mating halves of the tool unit. The halves are positioned with regard to axle hole recesses 24 and 34 that secure the axle 25 in its predetermined location. A joining device, or devices, such as a screw or screws, or snap assembly, or other fastener will maintain the unit in assembled status enclosing the blade and its retractable guard within their respective recesses. The respective halves may also be permanently joined by glue, an appropriate adhesive, or fusing. When different forms of blades are used or when a blade is intended to be replaceable, it is preferred that the mated sections be separable. As shown in FIG. 3, the contour lines illustrating side 20B show an essentially rounded back handle section 2 for grasping by the fingers that tapers to the recess 3A which receives the thumb or index finger on either end.

With further reference to FIG. 3, the cutter guard 8 includes central opening 81 that is received on the hub 23 in section 20A. From the opening 81 the guard extends to a diameter slightly exceeding the blade edge diameter to a terminus and thereafter includes a guard sheath 83 that extends perpendicularly downward to a depth such that the blade edge is covered by the guard when the guard is in place.

Dimensions of the cutter are not critical; however, the cutter is preferably sized to be physiologically appropriate to the hand of the average craftsperson that uses the cutter. In a prototype a front to back length dimension of 6.25 inches was found suitable. In such a unit, the distance from front section 4 to the rear of section 5 was 3.5 inches. The blade enclosed had a diameter of 1.75 inches; the diameter of the outer circumference of the guard was 2.0 inches with a thickness of about 0.1 inch extending approximately 0.25 inch downward. In a closed position, the guard extends 135° with respect to the hub center, fully enclosing the blade. Depression 3A in the handle side was an ellipse measuring about 1.0 inches by 1.675 inches on the handle surface tapering inward to a depth of 0.25 inches from the upper surface of the handle. The dimensions herein are approximate and other variations in configuration and assembly may be evident in view of the present description.

In use, the front 4 and rear 5 sections at either side of the blade provide guide bumps that assist in keeping the blade in line with a ruler. The cutter is comfortable to grasp with either the right or left hand. The cutter is designed so that the index finger (forefinger) of the user's hand extends longitudinally to rest on the front head section, letting the user point and accurately guide the cutter along the side of the ruler or cutting jib. In various configurations, the cutter side shape may be molded to accommodate a left handed user or a right handed user, with thumb indentation recesses (3A in section 3 as shown in FIG. 1), respectively on the right and left sides and lesser or no indentation on the opposite side of the handle. A preferred embodiment is an ambidextrous configuration with mirror images of the recessed indentation in area 3 for the thumb on both sides of the handle. It is preferred that the user's forefinger extend over head section 4. In an ambidextrous version section 4 is symmetrical and centered, while left and right handed versions may be weighted to one side or the other. The cutter fits naturally in the palm of the hand, placing the cutter under the palm, not in front of the hand where strain on the carpel tunnel area of the wrist would otherwise be created. The cutter uses the 1.75 inch (45 mm) blade currently on the market, and is adaptable to include cutters for pinking and decorative cuts. The built-in guard fully encloses any of the blades.

The invention thus provides a physiologically appropriate hand-held cutter for fabric and sheet goods with a rotary cutter blade. The blade is encased within a handle that includes a recessed depression within the handle surface in the area of the handle enclosing the blade. The user's thumb is positioned within the recess when the cutter is in use. The head section in front of the section enclosing the blade receives the user's forefinger, preferably on the upper surface thereof. The cutter fits naturally in the palm of the hand and reduces strain on the carpel tunnel area of the wrist. The cutter will work with any of the quilting and fabric rulers on the market and it is also designed to be compatible with the most popular jig cutting system.

While the blade guard fully encases the blade, it is not necessary to provide a pressure spring used at blade mount. In its assembly, the cutter is injection molded plastic in three parts, then assembled with the axle and standard components including the cutting wheel.

What is claimed is:

1. A physiologically appropriate hand-held cutter for fabric and sheet goods comprising a rotary cutter blade within a handle, the handle including a first gripping section by which the handle is grasped within a hand, the first section being formed from a rigid structural material and having a curved longitudinal shape that is rounded in cross-section, the gripping section intrinsically connected with a blade section within which the rotary cutter blade is mounted, the blade section extending from the handle and including on the exterior surface thereof a recessed depression within the surface essentially proximate the blade within, the depression forming a grip for insertion of a user's thumb when the cutter is in use, the handle further including forward and behind the blade section enclosing the blade a head section and a trailing section at opposite edges of the blade intrinsically extending from the blade section.

2. The cutter of claim 1 in which the head section includes a curve in a direction opposite that of the curved handle, the curve in the head section adapted to receive therein a user's forefinger when the user's thumb is positioned within the recessed depression.

3. The cutter of claim 1 formed of mating sections, whereby the blade section of one mating section is removable to allow access to the blade.

4. The cutter of claim 1 including a blade guard.

5. The cutter of claim 4 in which the blade guard is retractable and is mounted on a hub formed within the handle, the hub for the guard being positioned concentric with an axle on which the rotary blade is supported.

6. The cutter of claim 1 configured such that the forefinger of the hand grasping the cutter extends forward beyond the blade section and extends to and over the head section of the handle.

7. The cutter of claim 1 adapted for grasping by a right hand user wherein said cutter has a left side and a right side, the recessed depression being located on the left side and a lesser or no indentation on the right side of the handle.

8. The cutter of claim 1 adapted for grasping by a left hand user wherein said cutter has a left side and a right side, the recessed depression being located on the right side and a lesser or no indentation on the left side of the handle.

9. The cutter of claim 1 in an ambidextrous configuration adapted for grasping by either a right hand or a left hand in which either side of the handle is essentially a mirror image of the other and the head section is symmetrical and centered.

* * * * *